US005226332A

United States Patent [19]

Wassell

[11] Patent Number: 5,226,332

[45] Date of Patent: Jul. 13, 1993

[54] VIBRATION MONITORING SYSTEM FOR DRILLSTRING

[75] Inventor: Mark E. Wassell, Glastonbury, Conn.

[73] Assignee: Baker Hughes Incorporated, Houston, Tex.

[21] Appl. No.: 703,171

[22] Filed: May 20, 1991

[51] Int. Cl.[5] ..... E21B 47/00

[52] U.S. Cl. ..... 73/151; 73/493; 73/650; 175/40

[58] Field of Search ..... 73/151, 650, 570, 493, 73/494, 514; 175/40

[56] References Cited

U.S. PATENT DOCUMENTS 3,626,482 12/1971 Quichaud et al. ..... 73/151
4,715,451 12/1987 Bseisu et al. ..... 73/151
4,958,125 9/1990 Jardine et al. ..... 73/151

*Primary Examiner*—Hezron E. Williams
*Assistant Examiner*—Michael Brock
*Attorney, Agent, or Firm*—Fishman, Dionne & Cantor

[57] ABSTRACT

A vibration monitoring system operates down-hole in the bottom hole assembly above the drill bit. This system includes four spaced accelerometers which measure and differentiate between lateral, longitudinal and torsional drillstring vibrations. Three of the four accelerometers are in a cooperative spaced arrangement and measure tangential acceleration forces on the outer diameter of the drillstring for determining and measuring both lateral and torsional vibrations. The fourth accelerometer measures longitudinal vibration. Two embodiments are disclosed for arranging the three accelerometers which measure lateral and torsional vibration. In a first embodiment, the accelerometers are equispaced 120 degrees apart from one another. In a second embodiment, the three accelerometers are spaced 30 degrees apart from one another within a 60 degree arc. In both embodiments, all four accelerometers are positioned within the annular wall of a drill collar segment.

18 Claims, 3 Drawing Sheets

VIBRATION MONITORING SYSTEM FOR DRILLSTRING

BACKGROUND OF THE INVENTION

This invention relates to a method and apparatus for measuring vibration in a drillstring. More particularly, this invention relates to a measurement-while-drilling (MWD) tool which detects and measures longitudinal, torsional and lateral vibration downhole during the drilling of a borehole.

Vibrations within a drillstring are associated with a variety of drilling problems. For example, if the amplitude of vibration is large, drilling performance is decreased and the drillpipe, drillcollar, casing and bit are prematurely worn. In addition, drillstring failures may result from increased bending induced by the vibration. The drillstring can exhibit three types of vibrational motion, longitudinal (or axial), transverse (or lateral) and torsional. Longitudinal or axial vibrations are associated with bit and kelly bounce. Transverse vibrations are associated with bending of the drillpipe. Torsional vibrations can lead to stick slip drilling problems as well. When vibrational amplitudes are high, the drillpipe is continually loaded and unloaded, leading to a deterioration of drillpipe strength. Torsional oscillations at the bit also have a large negative effect on drilling performance.

As is clear from the foregoing, it is extremely important to detect and measure the vibrational motion of a drillstring during the drilling operation. Pertinent data, such as critical speeds and high vibration levels can be transmitted to the surface. This information can then be used to determine rotary speeds and to warn of high vibration. Avoiding critical speeds increases the life of the drillstring and results in drilling efficiency. Normally, most of the drilling energy is applied to formation of the borehole. However, if operating at an undesired resonance, most of the drilling energy is absorbed by resonance and very little goes into borehole formation.

Several methods are known for detecting such drillstring vibration. For example, an article entitled "Measurement of BHA Vibration Using MWD", D. A. Close et al, (IADC/SPE) 17273 describes a three axis vibration or resonance detector system which utilizes an array of strain gages. However, three axis resonance detectors of this type suffer from certain problems and deficiencies including the inability to differentiate between lateral and torsional vibrations.

U.S. Pat. No. 4,958,125 to Jardine et al describes a vibration sensing tool which includes four accelerometers disposed 90 degrees from each other; and which measure vibrational forces radially with respect to the outer diameter of the drillstring.

SUMMARY OF THE INVENTION

The above-discussed and other problems and deficiencies of the prior art are overcome or alleviated by the vibration or resonance detection apparatus of the present invention. In accordance with this invention, a vibration monitoring system operates down-hole in the bottom hole assembly above the drill bit. This system includes four spaced accelerometers which measure and differentiate between lateral, longitudinal and torsional drillstring vibrations. Three of the four accelerometers are in a cooperative spaced arrangement and measure tangential acceleration forces on the outer diameter of the drillstring for determining and measuring both lateral and torsional vibrations. The fourth accelerometer measures longitudinal vibration.

Two embodiments are disclosed for arranging the three accelerometers which measure lateral and torsional vibration. In a first embodiment, the accelerometers are equi-spaced 120 degrees apart from one another. In a second embodiment, the three accelerometers are spaced 30 degrees apart from one another within a 60 degree arc. In both embodiments, all four accelerometers are positioned within the annular wall of a drill collar segment.

In a preferred embodiment, two vibration detection and measurement systems in accordance with this invention are employed within a drillstring. A first vibration detection system is positioned in a drill collar segment above the bit for the measurement of vibrational forces on the exterior of the drillstring. A second system is mounted in the pressure housing which retains and supports the measurement-while-drilling microprocessor and electronics and will measure vibrations transmitted through the suspension system to determine Performance of the suspension system. Both systems may be used in tandem to compare and verify the accuracy of each system.

The vibration measurement system of this invention will accurately measure and distinguish lateral, longitudinal and torsional vibration amplitudes in a drillstring during the drilling operation. The feature of this invention wherein lateral and torsional vibrations are determined individually is an important advantage over prior art vibration measurement systems.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
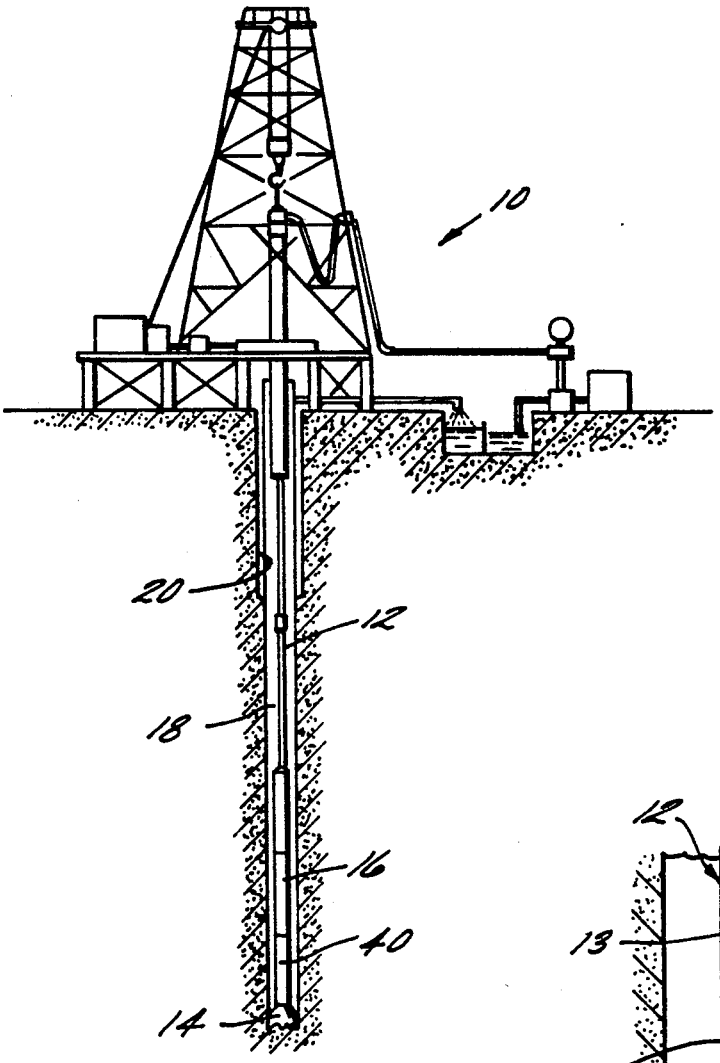
FIG. 1 is a diagrammatic view of a drill rig and apparatus used in accordance with this invention.

Referring to FIG. 1, a drilling apparatus in shown having a derrick structure 10 which supports a drillstring or drill stem, indicated generally as 12, which terminates in a drill bit 14. As is well known in the art, the entire drillstring may rotate, or the drillstring may be maintained stationary and only the drill bit rotated. The drillstring 12 is made up of a series of interconnected pipe segments, with new segments being added as the depth of the well increases.

The lower part of the drillstring may contain one or more segments 16 of larger diameter than the other segments of the drillstring. As is well known in the art, these larger diameter segments (known as drill collar segments) may contain sensors and electronic circuitry for preprocessing signals provided by the sensors. Drillstring segments 16 may also house power sources such as mud driven turbines which drive generators, the generators in turn supplying electrical energy for operating the sensing elements and any data processing circuitry. An example of a system in which a mud turbine, generator and sensor elements are included in a lower drillstring segment may be seen from U.S. Pat. No. 3,693,428 to which reference is hereby made. Drill cuttings produced by the operation of drill bit 14 are carried away by a mud stream 13 which flows down through the center of drillstring 12 and then rises up through the free annular space 18 between the drillstring and the wall 20 of the well (as indicated by the arrows).

Figure 2:
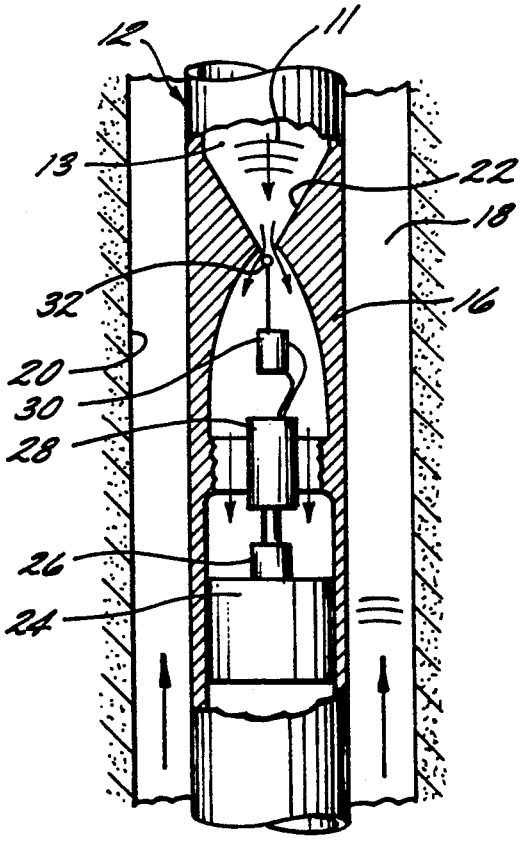
FIG. 2 is a side elevation view, partly in cross-section, of a MWD mud pulse telemetry apparatus.

In a MWD system as illustrated in FIG. 2, the mud column 13 in drillstring 12 serves as the transmission medium for carrying signals of downhole drilling parameters to the surface. This signal transmission is accomplished by the well known technique of mud pulse generation or mud pulse telemetry (MPT) whereby pressure pulses represented schematically at 11 are generated in the mud column 13 in drillstring 12 representative of parameters sensed downhole.

The drilling parameters may be sensed in a sensor unit 28 in drillstring segment 16, as shown in FIG. 2 which is located near to the drill bit. In accordance with well known techniques, the pressure pulses 11 established in the mud stream 13 in drillstring 12 are received at the surface by a pressure transducer and the resulting electrical signals are subsequently transmitted to a signal receiving and decoding device which may record, display and/or perform computations on the signals to provide information of various conditions downhole.

Still referring to FIG. 2, the mud flowing down drillstring 12 is caused to pass through a variable flow orifice 22 and is then delivered to drive a turbine 24. The turbine 24 is mechanically coupled to, and thus drives the rotor of a generator 26 which provides electrical power for operating the sensors in the sensor unit 28. The information bearing output of sensor unit 28, usually in the form of an electrical signal, operates a valve driver 30, which in turn operates a plunger 32 which varies the size of variable orifice 22. Variations in the size of orifice 22 create the pressure pulses 11 in the drilling mud stream and these pressure pulses are sensed at the surface by the aforementioned transducer to provide indications of various conditions which are monitored by the condition sensors in unit 28. The direction of drilling mud flow is indicated by arrows on FIG. 2. The pressure pulses 11 travel up the downwardly flowing column of drilling mud and within drillstring 12.

In accordance with the present invention, a vibration monitoring system is provided for operation downhole in the bottomhole assembly above the bit. This vibration monitoring system may be provided to a drill collar section to define a downhole resonate alert tool as identified at 40 in FIG. 1. The vibration monitoring system of the present invention can accurately measure and distinguish between the three types of downhole vibrations, namely, longitudinal, lateral and torsional vibrations.

Figure 3:
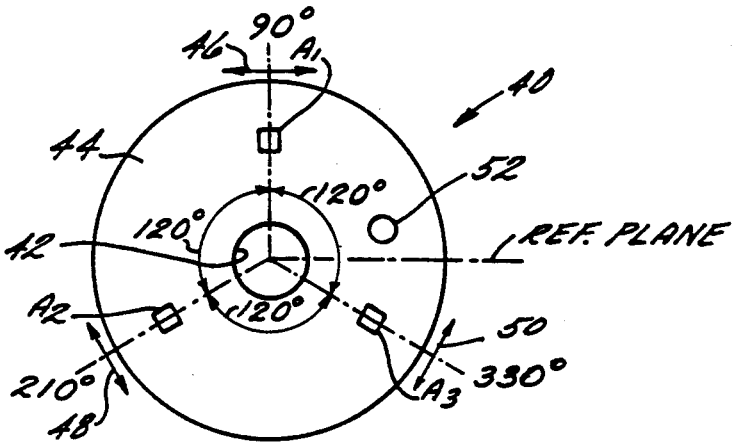
FIG. 3 is a schematic diagram depicting a first embodiment of an apparatus for measuring longitudinal, lateral and torsional vibration in a drillstring in accordance with this invention.

The vibration monitoring apparatus comprises four spaced accelerometers positioned within the wall of a drill collar section. Three of these four accelerometers cooperate and interact with one another to measure and distinguish between lateral and torsional vibrations. The fourth accelerometer measures longitudinal vibrations. A first configuration of a vibration monitoring apparatus in accordance with the present invention is shown in FIG. 3. In FIG. 3, a schematic diagram is shown of a cross-section of a drill segment 40 having an interior longitudinal opening 42 and a drill collar wall 44. Four accelerometers are shown within the wall 44 of drill collar section 40. Three accelerometers are schematically identified by the rectangular box and identified by $A_1$, $A_2$ and $A_3$. These three accelerometers are positioned 120° apart from one another and are also positioned to measure tangential acceleration forces on the outer circumference of drill collar 40. Accelerometer $A_1$, is positioned 90° from a reference plane. The measurement of tangential forces are indicated by the tangential lines 46, 48 and 50.

In accordance with the FIG. 3 embodiment, the following equations are utilized to measure torsional vibration (Equation 1), lateral vibration (for a given angle) (Equation 2) and maximum lateral vibration angle (Equation 3).

$$A_{To} = \frac{A_1 + A_2 + A_3}{3} \tag{1}$$

$$A_{L\alpha} = \frac{1}{3}\left\{\frac{A_1 - A_{To}}{\mathrm{Sin}(90-\alpha)} + \frac{A_2 - A_{To}}{\mathrm{Sin}(210-\alpha)} + \frac{A_3 - A_{To}}{\mathrm{Sin}(330-\alpha)}\right\} \tag{2}$$

$$\alpha_{max} = \tan^{-1}\left\{\frac{A_{1L} + A_{2L}\cdot\mathrm{Cos}(120) + A_{3L}\cdot\mathrm{Cos}(240)}{A_{1L} + A_{2L}\cdot\mathrm{Cos}(120) + A_{3L}\cdot\mathrm{Sin}(240)}\right\} \tag{3}$$

Figure 4:
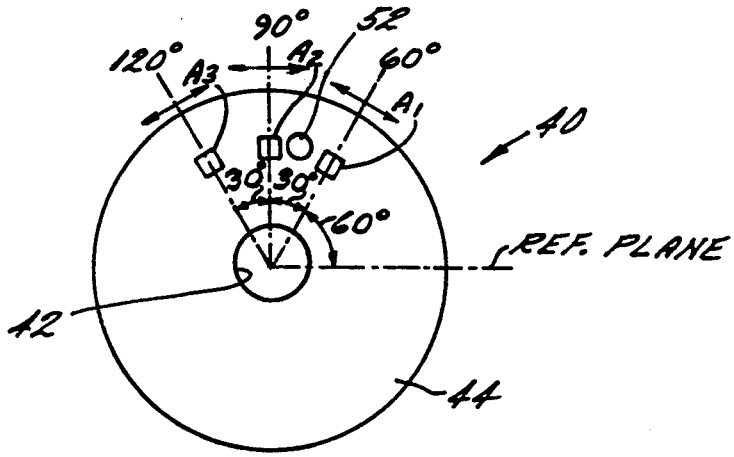
FIG. 4 is a schematic diagram depicting a second embodiment of an apparatus for measuring longitudinal, lateral and torsional vibration in a drillstring in accordance with this invention.

In accordance with a second embodiment of the present invention as shown in FIG. 4, the three accelerometers $A_1$, $A_2$ and $A_3$ are positioned 30° from one another and as in the first embodiment, are positioned to measure the tangential acceleration forces on drill collar 40. The three accelerometers $A_1$, $A_2$ and $A_3$ are clustered in a 60° arc of drill collar segment 40 with the first accelerometer $A_1$ being positioned 60° from a reference plane. The following equations 4, 5 and 6 are used to calculate torsional vibration (Equation 4), lateral vibration (for a given angle, Equation 5) and the maximum lateral vibration angle Equation 6.

$$A_{To} = \frac{A_1 + A_2 + A_3}{3} \tag{4}$$

$$A_{L\alpha} = \frac{1}{3}\left\{\frac{A_1 - A_{To}}{\mathrm{Sin}(90-\alpha)} + \frac{A_2 - A_{To}}{\mathrm{Sin}(120-\alpha)} + \frac{A_3 - A_{To}}{\mathrm{Sin}(30-\alpha)}\right\} \tag{5}$$

Maximum Vibration Angle:

$$\alpha_{max} = \tan^{-1}\left\{\frac{A_{1L} + A_{2L}\cdot\mathrm{Cos}(120) + A_{3L}\cdot\mathrm{Cos}(240)}{A_{2L}\sin(120) + A_{3L}\sin(240)}\right\} \tag{6}$$

In both embodiments, the accelerometers $A_1$, $A_2$ and $A_3$ are preferably co-planar (with respect to a cross-section of drill collar segment 40) to insure accurate measurements.

In both the embodiments of FIG. 3 and FIG. 4, a fourth accelerometer 52 is used to measure longitudinal vibrations. This measurment entials a straight forward reading directly from the accelerometer.

The accelerometer $A_1$, $A_2$, $A_3$ and 52 are preferably piezoelectric and are commercially available.

Figure 5:
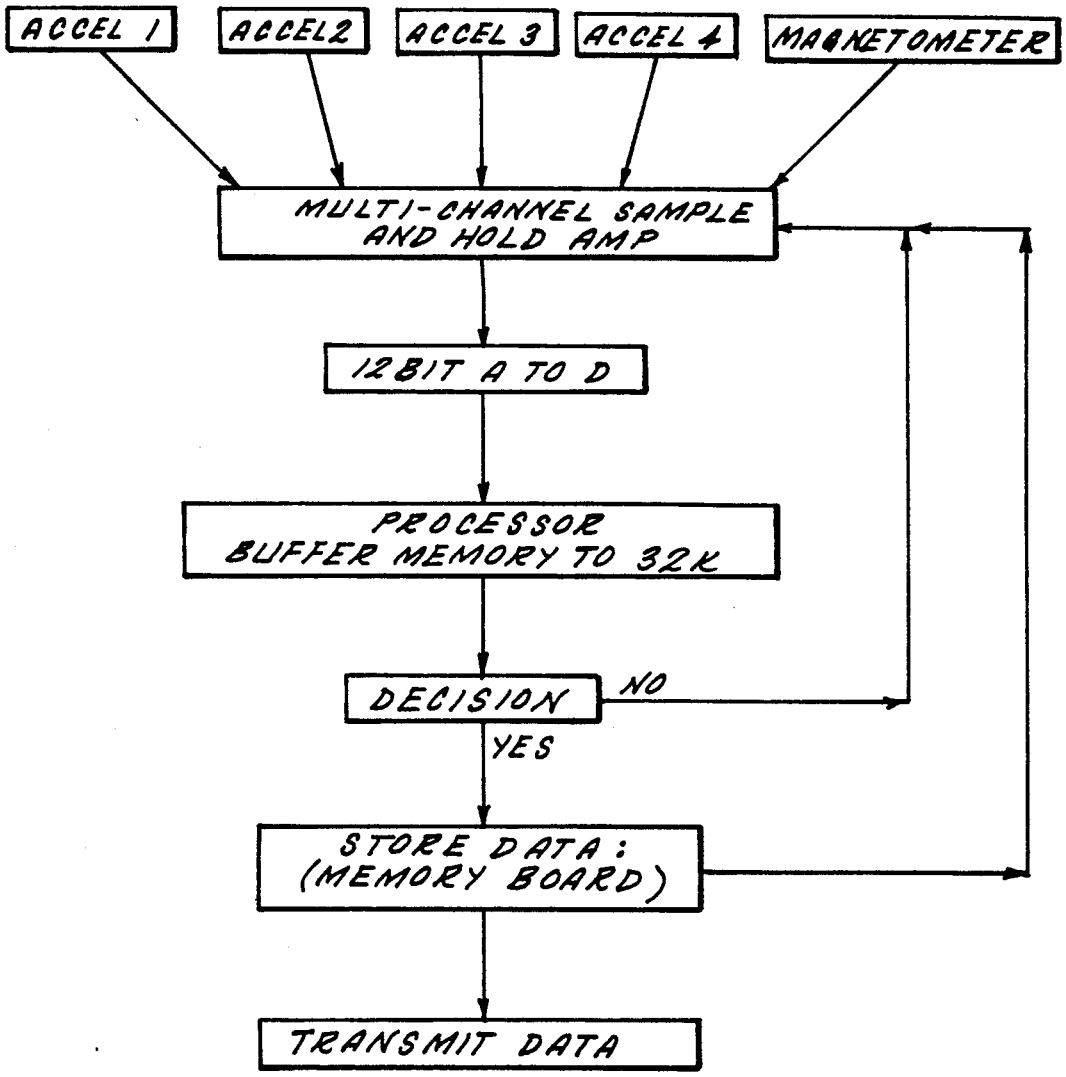
FIG. 5 is a schematic diagram of the electronic Processing scheme for use with this invention.

Referring now to FIG. 5, an electrical schematic is shown for processing the electronic data acquired by the accelerometer measurements in accordance with either the embodiments of FIG. 3 or 4. It will be appreciated that the accelerometer measurements should be taken simultaneously to accurately obtain and process the data. The four accelerometers will be read by a multi-channel sample and hold amplifier. A magnetometer reading (associated with the measurement-while-drilling apparatus) will be used for determining rotary speed in accordance with the teachings of U.S. Pat. No. 4,013,945, which is assigned to the assignee hereof and incorporated herein by reference. A twelve bit analog-to-digital (A-D) board is used to input the data to a Processor. The processor preferably has a 32K buffer memory to temporarily store the data while processing. Because of the limited memory, the processor will reduce the data to spectral data, and then decide whether to store the data in memory. Only data over a given frequency range will be stored. The eight most severe vibration data will be stored. In a typical downhole drilling scenario, the vibration range of interest is 0.1 Hz to 2000 Hz.

Figure 6:
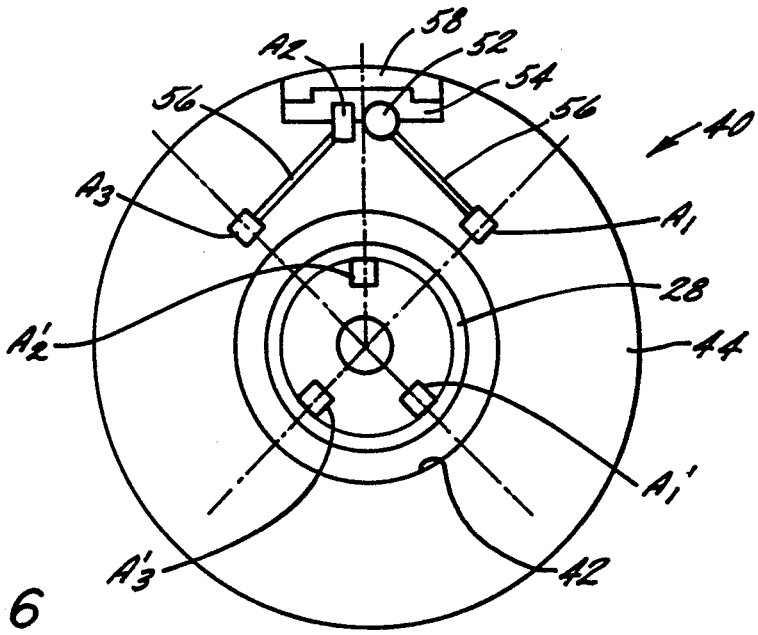
FIG. 6 is a schematic diagram depicting a preferred configuration of a vibration measurement apparatus in accordance with this invention.

The vibration sub shown at 40 in FIG. 1 is preferably 5 to 6 feet long and located below the directional tool. As shown in FIG. 6, the sub 40 preferably has a hatch 54 formed in the wall 44 of the sub which will house the electronics and the accelerometers. Two accelerometers ($A_2$ and 52) will be mounted in the hatch. The other two accelerometers $A_1$ and $A_3$ will be mounted in holes 56 drilled from hatch 54 at an angle of 30° (in the case of the FIG. 4 embodiment) therefrom. A removable hatch cover 58 is positioned over hatch 54 and may be removed to service and/or repair the accelerometers and electronic package positioned within hatch 54. The hatch construction shown in FIG. 6 is similar to the hatch construction depicted in U.S. patent application Ser. No. 511,537 filed Apr. 17, 1990, which is assigned to the assignee hereof and fully incorporated herein by reference.

In a preferred embodiment of the present invention, two vibration detection and measurement systems are employed within a single drillstring. The first vibration detection system is employed in sub 40 within sub wall 44 as described hereinabove and shown in FIG. 6. This first vibration detection system is Positioned above the bit for the measurement of vibrational forces on the exterior of the drillstring. In accordance with a preferred embodiment of this invention, a second system is mounted within the pressure housing 28 (see FIGS. 2 and 6) within the computerized directional service module or CDS. This Pressure housing retains and supports the measurement-while-drilling microprocessor and electronics and a vibrational system mounted thereon will measure vibrations transmitted to the suspension system which supports the measurement-while-drilling microprocessor and electronics so as to determine performance of said suspension system. As shown in FIG. 6, the three accelerometers $A_1$, $A_2$ and $A_3$ in drill collar segment 40 are disposed in a 60° arc, 30° apart from one another in accordance with the embodiment of FIG. 4; while the three accelerometers $A'_1$, $A'_2$ and $A+_3$ in the electronic pressure housing 28 are disposed 120° apart in accordance with the embodiment of FIG. 3.

By having two independent systems, one in the sub wall and one in the CDS, the present invention provides information on the transmissibility of vibratory excitations from the drill collar into the CDS package.

Downhole vibration information concerning lateral, longitudinal and torsional vibrations may be stored downhole and/or transmitted to the surface via the MWD mud pulse telemetry apparatus. The vibration monitoring system of this invention may function in a variety of applications including as a resonance alert tool, alerting the surface operators to dangerous downhole vibrations as well as a research tool to study downhole vibrations and related phenomenon.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A vibration monitoring system for use in monitoring lateral and torsional vibrations in a drillstring comprising:

a drillstring component having an outer surface;

first accelerometer means $A_1$ for measuring tangential acceleration;

second accelerometer means $A_2$ for measuring tangential acceleration;

third accelerometer means $A_3$ for measuring tangential acceleration;

said first, second and third accelerometer means $A_1$, $A_2$ and $A_3$ being mounted in said drillstring component and being spaced from one another to measure acceleration forces on said drillstring component tangentially with respect to the outer surface of said component wherein said first, second and third accelerometer means are adapted to measure and distinguish between lateral and torsional vibrations exerted on said drillstring component.

2. The system of claim 1 wherein:

said first, second and third accelerometer means are spaced 120° apart from one another.

3. The system of claim 2 wherein torsional vibration on said drillstring component is determined by:

$$A_{TO} = \frac{A_1 + A_2 + A_3}{3}$$

4. The system of claim 2 wherein lateral vibration on said drillstring component for a specified angle is determined by:

$$A_{La} = \frac{1}{3}\left\{ \frac{A_1 - A_{TO}}{\mathrm{Sin}(90 - \alpha)} - \frac{A_2 - A_{TO}}{\mathrm{Sin}(210 - \alpha)} - \frac{A_3 - A_{TO}}{\mathrm{Sin}(330 - \alpha)} \right\}$$

5. The system of claim 2 wherein the maximum lateral vibration angle on said drillstring component is determined by:

$$\alpha_{max} = \tan^{-1}\left\{\frac{A_{1L} + A_{2L}\cdot \mathrm{Cos}(120) + A_{3L}\cdot \mathrm{Cos}(240)}{A_{2L}\sin(120) + A_{3L}\sin(240)}\right\}$$

6. The system of claim 1 wherein:

said first and third accelerometer means are spaced 30° apart from said second accelerometer means.

7. The system of claim 6 wherein torsional vibration on said drillstring component is determined by:

$$A_{To} = \frac{A_1 + A_2 + A_3}{3}$$

8. The system of claim 6 wherein lateral vibration on said drillstring component for a specified angle is determined by:

$$A_{La} =$$

$$\frac{1}{3}\left\{\frac{A_1 - A_{To}}{\mathrm{Sin}(90-\alpha)} - \frac{A_2 - A_{To}}{\mathrm{Sin}(120-\alpha)} - \frac{A_3 - A_{To}}{\mathrm{Sin}(30-\alpha)}\right\}$$

9. The system of claim 6 wherein the maximum lateral vibration angle on said drillstring component is determined by:

$$\alpha_{max} = \tan^{-1}\left\{\frac{A_{1L} + A_{2L}\cdot \mathrm{Cos}(120) + A_{3L}\cdot \mathrm{Cos}(240)}{A_{2L}\sin(120) + A_{3L}\sin(240)}\right\}$$

10. The system of claim 1 wherein:

said drillstring component comprises a drill collar segment with said first, second and third accelerometer means being disposed in a wall of said drill collar segment.

11. The system of claim 10 including:

a hatch in said drill collar segment, a removable hatch cover on said hatch with at least one of said accelerometers being disposed in said hatch.

12. The system of claim 1 wherein said drillstring includes an interior longitudinal opening for the passage of drilling fluid and a housing positioned within said opening, said housing retaining measurement-while-drilling electronics and wherein:

said drillstring component comprises said housing.

13. The system of claim 1 including:

a fourth accelerometer in said drillstring component for measuring longitudinal vibration in said drillstring.

14. The system of claim 1 wherein:

said first, second and third accelerometer means are coplanar.

15. A vibration monitoring system for use in monitoring lateral and torsional vibrations in a drillstring comprising:

a drillstring component having an outer surface;

first accelerometer means;

second accelerometer means;

third accelerometer means;

said first, second and third accelerometer means being mounted in said drillstring component and being mutually spaced 120° apart from one another to measure acceleration forces on said drillstring component with respect to the outer surface of said component wherein said first, second and third accelerometer means are adapted to measure and distinguish between lateral and torsional vibrations exerted on said drillstring component.

16. A vibration monitoring system for use in monitoring lateral and torsional vibrations in a drillstring comprising:

a drillstring component having an outer surface;

first accelerometer means;

second accelerometer means;

third accelerometer means;

said first, second and third accelerometer means being mounted in said drillstring component and being mutually spaced 30° apart from one another to measure acceleration forces on said drillstring component with respect to the outer surface of said component wherein said first, second and third accelerometer means are adapted to measure and distinguish between lateral and torsional vibrations exerted on said drillstring component.

17. A vibration monitoring system for use in monitoring lateral and torsional vibration in a drillstring, the drillstring having an interior longitudinal opening for the passage of drilling fluid, comprising:

a drill collar segment having an outer surface;

three discrete first accelerometer means mounted in said drill collar segment and being spaced from one another to measure acceleration forces on said drill collar segment tangentially with respect to the outer surface of said drill collar segment wherein said three first accelerometer means are adapted to measure and distinguish between lateral and torsional vibrations exerted on said drill collar segment;

a housing for retaining measurement-while-drilling electronics, said housing being positioned in said opening;

three discrete second accelerometer means mounted in said housing and being spaced from one another to measure acceleration forces on said housing tangentially with respect to the outer surface of said housing wherein said three second accelerometer means are adapted to measure and distinguish between lateral, and torsional vibrations exerted on said housing.

18. The system of claim 17 including:

means for comparing vibration measurement derived from said first accelerometer means to vibration measurements derived from said second accelerometer means.

* * * * *